US010526890B2

(12) United States Patent
Batmaz et al.

(10) Patent No.: US 10,526,890 B2
(45) Date of Patent: Jan. 7, 2020

(54) WORKFLOWS TO ADDRESS LOCALIZED STRESS REGIME HETEROGENEITY TO ENABLE HYDRAULIC FRACTURING

(71) Applicant: SCHLUMBERGER TECHNOLOGY CORPORATION, Sugar Land, TX (US)

(72) Inventors: Taner Batmaz, Muscat (OM); Stevanus Dwi Kurniadi, Muscat (OM); Omar Al Zeidi, Muscat (OM); Mehmet Nihat Gurmen, Dubai (AE); Christopher Fredd, Westfield, NY (US); Safdar Mohammad Khan, Dammam (SA); Douglas Bentley, Edmond, OK (US); Kousic Theja Kanneganti, Chennai (IN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 242 days.

(21) Appl. No.: 15/535,672

(22) PCT Filed: Dec. 18, 2015

(86) PCT No.: PCT/US2015/066546
§ 371 (c)(1),
(2) Date: Jun. 16, 2017

(87) PCT Pub. No.: WO2016/100762
PCT Pub. Date: Jun. 23, 2016

(65) Prior Publication Data

US 2017/0362935 A1 Dec. 21, 2017

Related U.S. Application Data

(60) Provisional application No. 62/094,638, filed on Dec. 19, 2014, provisional application No. 62/220,557, filed on Sep. 18, 2015.

(51) Int. Cl.

| | |
|---|---|
| ***E21B 49/00*** | (2006.01) |
| ***E21B 47/00*** | (2012.01) |
| ***E21B 49/02*** | (2006.01) |
| ***E21B 7/04*** | (2006.01) |
| ***E21B 34/06*** | (2006.01) |
| ***E21B 43/114*** | (2006.01) |

(Continued)

(52) U.S. Cl.
CPC ..... *E21B 49/006* (2013.01); *E21B 47/0002* (2013.01); *E21B 49/02* (2013.01);
(Continued)

(58) Field of Classification Search
CPC .... E21B 49/006; E21B 49/02; E21B 47/0002; E21B 43/267; E21B 43/26
See application file for complete search history.

(56) References Cited

U.S. PATENT DOCUMENTS 9,784,090 B2 * 10/2017 Baria ..... E21B 43/30
2004/0176911 A1 9/2004 Bratton et al.
(Continued)

FOREIGN PATENT DOCUMENTS

WO 2014140752 A1 9/2014

OTHER PUBLICATIONS

Wigger et al., "Logging Solutions for Completion Optimization in Unconventional Resource Plays", SPE 167726, Society of Petroleum Engineers, SPE/EAGE European Unconventional Conference and Exhibition, Feb. 25-27, 2014, 17 pages.
(Continued)

*Primary Examiner* — Bryan Bui

(57) ABSTRACT

A method includes identifying one or more stress regime types along at least a portion of a borehole, where the stress regime types are selected from a normal stress regime, a thrust stress regime and a strike-slip stress regime, and selecting reservoir access locations along the borehole based on the type of stress regime identified along the borehole.

20 Claims, 10 Drawing Sheets

(51) Int. Cl.

| | |
|---|---|
| ***E21B 43/116*** | (2006.01) |
| ***E21B 43/16*** | (2006.01) |
| ***E21B 43/26*** | (2006.01) |
| ***E21B 43/267*** | (2006.01) |
| ***E21B 34/00*** | (2006.01) |

(52) U.S. Cl.

CPC ..... *E21B 7/04* (2013.01); *E21B 34/063* (2013.01); *E21B 43/114* (2013.01); *E21B 43/116* (2013.01); *E21B 43/16* (2013.01); *E21B 43/26* (2013.01); *E21B 43/267* (2013.01); *E21B 2034/007* (2013.01)

(56) References Cited

U.S. PATENT DOCUMENTS

| | | | |
|---|---|---|---|
| 2009/0242198 | A1 | 10/2009 | Evans et al. |
| 2009/0250211 | A1 | 10/2009 | Craig |
| 2010/0101790 | A1 | 4/2010 | Hansen et al. |
| 2011/0182144 | A1 | 7/2011 | Gray |
| 2013/0032350 | A1 | 2/2013 | Potapenko et al. |
| 2013/0206475 | A1 | 8/2013 | Prioul et al. |
| 2013/0206476 | A1 | 8/2013 | Innes et al. |
| 2014/0069653 | A1 | 3/2014 | Liu et al. |

OTHER PUBLICATIONS

International Search Report and Written Opinion issued in International Patent Appl. No. PCT/US2015/066546 dated Apr. 1, 2016; 14 pages.

International Search Report and Written Opinion issued in International Patent Appl. No. PCT/US2016/052412 dated Dec. 26, 2016; 10 pages.

* cited by examiner

WORKFLOWS TO ADDRESS LOCALIZED STRESS REGIME HETEROGENEITY TO ENABLE HYDRAULIC FRACTURING

CROSS-REFERENCE TO RELATED APPLICATIONS

This application claims the benefit of U.S. Provisional Patent Application 62/094,638 filed on Dec. 19, 2014 and U.S. Provisional Patent Application Ser. No. 62/220,557, filed on Sep. 18, 2015 entitled, "Workflow To Optimize Staging And Completion Design In Tectonically Active Areas To Enable Hydraulic Fracturing." Both applications are incorporated by reference herein.

BACKGROUND

Hydrocarbons (oil, natural gas, etc.) are obtained from a subterranean geological formation, or reservoir, by drilling a well that penetrates the hydrocarbon-bearing formation. This provides a partial flowpath for the hydrocarbon to reach the surface. In order for the hydrocarbon to be produced, that is travel from the formation to the wellbore and ultimately to the surface, a sufficiently unimpeded flowpath should be formed from the formation to the wellbore.

Hydraulic fracturing may improve well productivity by extending reservoir contact between the borehole and the reservoir. This operation may be performed by hydraulically injecting a fracturing fluid into a wellbore penetrating the formation and forcing the fracturing fluid against the formation strata by pressure. The formation strata or rock is forced to crack and fracture, thereby increasing flow paths between the reservoir and the borehole. Proppant may be placed in the fracture to prevent the fracture from closing and thus, provide improved flow of the recoverable hydrocarbons.

Hydraulic fracturing for well stimulation includes pumping the fracturing fluid at a bottomhole pressure sufficient to overcome the formation in-situ stresses so that the rock can be cracked. An effective bottomhole pressure may be the sum of the surface pressure provided by the pumping equipment and the hydrostatic pressure, minus the pressure losses due to friction forces while the fluid passes through the surface and subterranean equipments such as pipes. The bottomhole pressure may be governed by the mechanical properties of the formation, and may be higher as the borehole extends deeper.

Once a fracture is initiated, enough bottomhole pressure may be maintained to propagate the fracture further away from the wellbore and generate the necessary fracture width for it to be filled with the propping material that will keep the fracture open once the pumping has stopped. The initial breakdown pressure may be higher than the minimum pressure needed to re-open the same fracture due to geomechanical effects in the near well bore region as the far-field stress state interacts with the void space created by the drilling activity.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to methods that include identifying one or more stress regime types along at least a portion of a borehole, where the stress regime types are selected from a normal stress regime, a thrust stress regime and a strike-slip stress regime, and selecting reservoir access locations along the borehole based on the type of stress regime identified along the borehole.

In another aspect, embodiments of the present disclosure relate to methods that include collecting data characterizing a formation around at least a portion of a borehole, locating at least one localized normal stress regime based on the collected data, and altering a trajectory of the borehole to extend through the at least one located localized normal stress regime.

In yet another aspect, embodiments of the present disclosure relate to methods that include calculating a differential stress along at least a portion of a borehole, where the differential stress is the difference between the magnitude of two principle stresses acting on the borehole, the principle stresses selected from vertical stress, minimum horizontal stress, and maximum horizontal stress, determining locations along the borehole having a relatively higher differential stress when compared with the remaining calculated differential stresses, and perforating the borehole at a reservoir access location selected from at least one of the locations.

Other aspects and advantages of the invention will be apparent from the following description and the appended claims.

DETAILED DESCRIPTION

Figure 1:
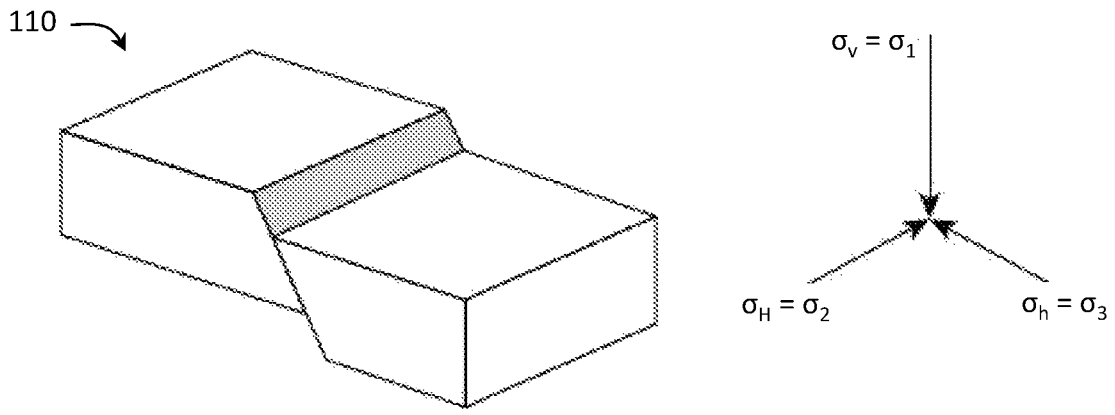
FIG. 1 shows a normal fault and its stress regime.

In determining the completion quality of a wellbore, stress regimes may be analyzed and considered when selecting reservoir access locations along the wellbore. For example, engineered completions for multistage fracturing developed to address challenges with reservoir heterogeneity in reservoirs that are generally in a normal stress regime may be designed to place reservoir access locations in low stress regions along the wellbore. Reservoir access locations may include, for example, perforations used in hydraulic fracturing operations or channels created by acidizing in matrix stimulation operations. Reservoir access locations may be formed, for example, using perforation guns, abrasive jetting, notching, sleeves, and others.

It has been observed that some hydrocarbon reservoirs exhibit geomechanical challenges that prevent execution of hydraulic fracturing treatments as conducted for reservoirs in a normal stress regime. These challenges are due to "localized stress regime heterogeneity," caused by local or regional tectonic effects, complex geology (e.g., laminations) in the region, and other geological factors such as salt domes, faulting and others. This localized stress regime heterogeneity is manifested in changes in the relative magnitude of principal stresses (vertical stress, maximum horizontal stress, and minimum horizontal stress) which can result in local characteristics of normal, strike-slip, and thrust stress regimes along the wellbore. If using a single approach that may be successful in normal stress regimes, problems may be encountered when trying to use the same approach for placing hydraulic fracturing treatments in locations along the wellbore that are characteristic of the strike-slip or thrust regime. This localized stress regime heterogeneity has been observed, for example, in wells in countries around the Middle East Area, including in Oman, Saudi Arabia, Kuwait, United Arab Emirates, and India. Localized stress regime heterogeneity may also occur in other regions around the world.

For example, deep high pressure/high temperature (HPHT) dolomite formations, such as found in northern Kuwait, may present a challenge with varied production, attributable to reservoir heterogeneity. Due to the tight nature of these rocks, an operator may turn to hydraulic fracturing to produce at economic rates.

According to embodiments of the present disclosure, a general approach for optimizing completions to enable hydraulic fracturing may include placing reservoir access locations, such as perforation clusters, in good reservoir quality (RQ) and good completion quality (CQ). A workflow for optimizing completions may include an integrated petrophysical evaluation of one or more current wells, followed by a multi-well heterogeneous rock analysis (HRA), to evaluate the reservoir heterogeneity across the field and identify optimal locations for future drilling. Evaluation of past or current stimulation treatments may be used to understand geo-mechanical challenges and to calibrate a Mechanical Earth Model (MEM) (i.e., a numerical representation of the geomechanical state of the reservoir, field, or basin) for implementation in the future drilling locations.

According to some embodiments, a method for optimizing completions may include obtaining measurements characterizing the stress regime of a wellbore and either targeting locations with a normal stress regime or overcoming fracture placement challenges in non-normal stress regimes (i.e., strike-slip or thrust stress regimes). For example, targeting locations with a normal stress regime may include changing a well trajectory or selecting reservoir access locations along normal stress regimes in a wellbore. Overcoming fracture placement challenges in non-normal stress regimes may include selecting reservoir access locations (e.g., perforations) in certain high stress regions of the non-normal stress regimes or in regions of the non-normal stress regimes having high differential stress between two principle stresses acting on the borehole.

Due to the heterogeneous nature of hydrocarbon reservoirs, a large amount of data may be gathered in order to characterize vertical and horizontal variations of the reservoir, natural fractures, and rock properties to optimize stimulation designs and completion practices. Without sufficient information, completion effectiveness can vary significantly. One component of improving performance of oil or gas wells may include identifying the zones of the best reservoir quality and also the best completion quality according to one or more selected criteria of reservoir quality and completion quality.

Reservoir quality may refer to characteristics of where and how the hydrocarbon is stored in the reservoir, for example, porosity, permeability, saturations, and amount of hydrocarbon. Completion quality may refer to characteristics describing or quantifying the ability to fracture a formation near the wellbore, for example, stress type and magnitude and other qualities of the reservoir that define the near-wellbore rock mechanical properties. While characteristics of reservoir quality may be fixed within the relatively short distances along or around the wellbore (e.g., the porosity of the formation may not be changed, but understanding the porosity of the formation may be used for improving the design of a fracturing operation), characteristics of completion quality may be altered, for example, by moving the location or direction of the wellbore or by selecting different reservoir access locations.

Reservoir quality and far field hydraulic fracture geometry and conductivity have been believed to be the only primary factors that affect well performance in reservoirs having mixed or non-normal stress regimes. However, inventors of the present disclosure have found that initiation and near-wellbore fracture geometry and conductivity can be primary factors affecting horizontal or vertical well performance and overall success. Thus, according to embodiments of the present disclosure, completion quality may be considered when designing stages and reservoir access locations.

In considering completion quality, the localized stress regime of the near-wellbore formation may be analyzed. The state of the stresses in the formation is represented by magnitude and the direction of three principle stresses, which are mainly known as vertical stress, maximum horizontal stress, and minimum horizontal stress in petroleum geomechanics. Determining changes in the relative magnitude of principal stresses (vertical stress, maximum horizontal stress, and minimum horizontal stress) may indicate local characteristics of normal, strike-slip, and thrust stress regimes along the wellbore. The three principal stresses may be used to quantify and describe the state of stress a formation is under, where the principal stresses may be local compressive stresses on a formation (e.g., near-wellbore formations) that vary in magnitude on the basis of direction.

Figure 2:
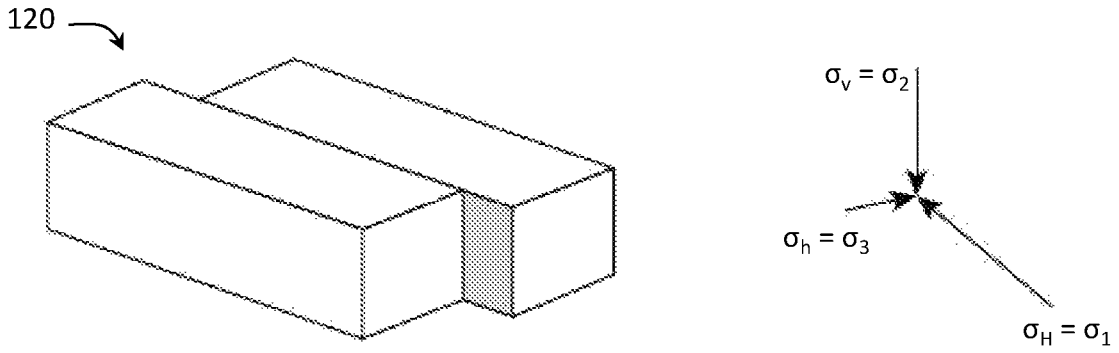
FIG. 2 shows a strike-slip fault and its stress regime.
Figure 3:
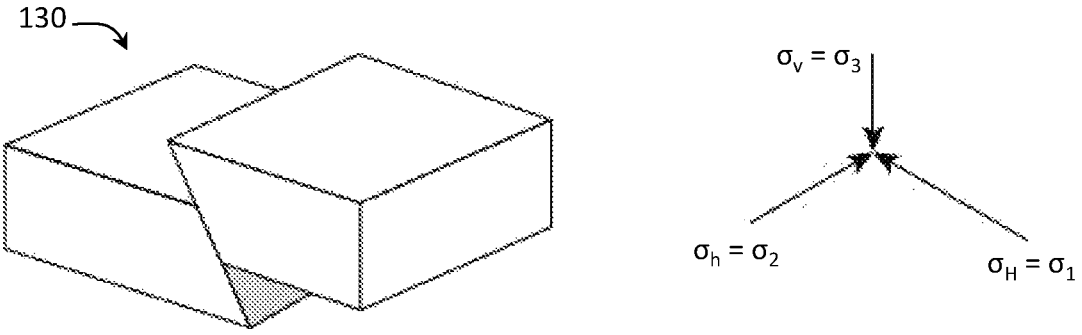
FIG. 3 shows a thrust fault and its stress regime.

The ratios of the three principle stresses may signal stress regime conditions. For example, FIGS. 1-3 show diagrams of the three principal compressive stresses on local formations in different stress regimes. As shown in FIG. 1, when the difference in magnitude between the vertical stress $\sigma_v$ and the maximum horizontal stress $\sigma_H$ is less than the difference in magnitude between the vertical stress $\sigma_v$ and the minimum horizontal stress $\sigma_h$, a normal stress regime 110 is indicated. Further, vertical stress $\sigma_v$ in a normal stress regime is often the largest of the principle stresses, or in other words, the vertical stress $\sigma_v$ often has the largest magnitude compared to minimum and maximum horizontal stress $\sigma_h$, $\sigma_H$. In the example shown in FIG. 1, the vertical stress $\sigma_v$ has the greatest magnitude ($\sigma_1$), the minimum horizontal stress $\sigma_h$ has the lowest magnitude ($\sigma_3$), and the maximum horizontal stress $\sigma_H$ has a magnitude ($\sigma_2$) between that of the vertical stress $\sigma_v$ and minimum horizontal stress $\sigma_h$. As shown in FIG. 1, a normal fault regime 110 may include a fracture in a formation, where a divided formation block has shifted mostly in a vertical direction, and where the formation block above an inclined fault moves downward.

As shown in FIG. 2, when the maximum horizontal stress $\sigma_H$ has the greatest magnitude ($\sigma_1$), the minimum horizontal stress $\sigma_h$ has the lowest magnitude ($\sigma_3$), and the vertical stress $\sigma_v$ has a magnitude ($\sigma_2$) between that of the maximum horizontal stress $\sigma_H$ and minimum horizontal stress $\sigma_h$, a strike-slip fault regime 120 is indicated. Strike slip faulting may be found, for example, in deeper zones where a stress relaxation has occurred due to presence of large fractures/faults, or tectonics. The stress relaxation may shift stresses, but vertical stress may remain almost unchanged. As shown in FIG. 2, a strike-slip fault regime 120 may include a vertical or nearly vertical fracture in a formation, where one or both of the divided formation blocks move horizontally relative to the other divided formation block.

Referring to FIG. 3, when the vertical stress $\sigma_v$ has the lowest magnitude of the principle stresses, a thrust fault regime 130 (sometimes referred to as a reverse thrust regime) is indicated. In the example shown in FIG. 3, the maximum horizontal stress $\sigma_H$ has the greatest magnitude ($\sigma_1$), the vertical stress $\sigma_v$ has the lowest magnitude ($\sigma_3$), and the minimum horizontal stress $\sigma_h$ has a magnitude ($\sigma_2$) between that of the vertical stress $\sigma_v$ and maximum horizontal stress $\sigma_H$. As shown in FIG. 3, a thrust fault regime 130 may include a fracture in a formation, where formation from a lower stratigraphic position is pushed up and over formation from a relatively higher stratigraphic position.

The magnitude and direction of the principal stresses, and thus also the indicated stress regime type, may be used to predict or determine how a fracture may propagate through a near-wellbore formation. For example, the principal stresses along a near-wellbore formation may be used to determine the pressure required to create and propagate fractures through the near-wellbore formation, the vertical extent, and the direction of the fractures (e.g., if the fractures propagate vertically or horizontally). Thus, localized stress regime heterogeneity along a wellbore may directly impact hydraulic fracture initiation and geometry.

Embodiments of the present disclosure may include determining the localized stress regime heterogeneity along a wellbore, which may include, for example, changes in magnitude of vertical stress, maximum horizontal stress, and minimum horizontal stress, thereby indicating variability from normal to strike slip to thrust stress regimes along the length of the wellbore. The localized stress regime along a wellbore may be used to determine optimized locations along the wellbore for reservoir access, e.g., perforations in a hydraulic fracturing operation.

For example, methods of the present disclosure may include identifying one or more stress regime types along at least a portion of a borehole within a hydrocarbon reservoir layer or within sufficient proximity to connect a hydraulic fracture to the hydrocarbon reservoir layer, where the stress regime types are selected from a normal stress regime, a thrust stress regime and a strike-slip stress regime, and selecting reservoir access locations based on the type of stress regime identified along the borehole. When at least one normal stress regime is identified, reservoir access locations may be selected along the borehole in at least one of the identified normal stress regimes. However, as described more below, additional factors may be used to select reservoir access locations. For example, reservoir access locations along the borehole may be selected that have a combination of good reservoir quality, good completion quality, and are in a normal stress regime. Stress regime types may be identified using measurements taken along the borehole quantifying stress, which may be taken, for example, using at least one of a sonic measurement tool, an image logging tool, core measurements, MDT, or fracture diagnostics tests. Further, seismic data of a field in which the borehole is located may be used to indicate localized stress heterogeneity along the borehole, for example, when used for seismic driven GeoMechanics or other seismic data analysis software.

In some embodiments, reservoir access locations may be selected based on a simulation of a borehole that is simulated as extending through a formation. As discussed more below, the simulation may be based on data collected from the formation, and the stress regime types may be calculated along the simulated borehole. The borehole may be drilled through the formation with a trajectory extending through at least one identified normal stress regime. In some embodiments, a new trajectory of the borehole may be modeled based on the simulation, where the new trajectory extends through at least one identified normal stress regime. Reservoir access may be formed between the drilled borehole and a reservoir, for example, by perforating, notching, or acidizing. Perforations may be created in the drilled borehole, for example, by perforating charges, abrasive jetting, multistage completions such as sliding sleeves, rupture valves or other means of connecting the wellbore to the reservoir.

Optimized locations for reservoir access locations along a wellbore may be selected based on optimized conditions for fracture initiation, fracture propagation, and fracture orientation. Hydraulic fracture initiation and propagation may be divided into four physical stages: fracture initiation (when the stress intensity factor reaches its critical value), fluid penetration (when a certain amount of fluid slowly penetrates the newly initiated crack), fracture breakdown (when the wellbore pressure reaches its peak value and the fracture starts to propagate and the fluid is released into the fracture), and pressure decline (when the effective rate of fluid entering the fracture is equal to the injection rate at the wellhead).

Fracture initiation in rocks may occur when the wellbore pressure is greater than the breakdown pressure (sum of minimum principle stress of the rock plus tensile strength of the rock ($-T_0$)). This results in tensile failure or splitting of the rock. Once a hydraulic fracture is initiated, it may extend or propagate away from the borehole when the wellbore pressure exceeds the fracture propagation stress, which is typically equal to the smallest principal stress ($\sigma_{min}$). Fracture orientation may be determined based on the smallest principal stress, where hydraulic fracture propagates in the direction of least resistance, normal to the smallest principal stress ($\sigma_{min}$). For example, if the smallest principal stress is in horizontal direction (i.e. the $\sigma_{min}=\sigma_{hmin}$), the resulting fractures will be vertical (relative to the earth's core). If the vertical stress is the least principal stress (i.e. $\sigma_{min}=\sigma_v$), the resulting fractures will be horizontal.

According to embodiments of the present disclosure, reservoir access locations along a borehole may be selected or designed such that reservoir access at the reservoir access locations extends vertically (relative to the earth's core). For example, perforations may be designed to have a vertical fracture orientation. Perforations may be designed to have a vertical fracture orientation, for example, by selecting reservoir access locations along a borehole having a smallest principle stress in a horizontal direction. For example, in some embodiments, principle stresses (vertical stress, minimum horizontal stress, and maximum horizontal stress) may be measured along a borehole, where at least one reservoir access location is selected along the borehole at a location having a measured minimum horizontal stress or a measured maximum horizontal stress as the lowest principle stress.

As used herein, breakdown pressure refers to the pressure at which the rock matrix of an exposed formation fractures and allows fluid to be injected. Breakdown pressure may be signified by the maximum pressure to overcome hoop stress before reaching the far field stress. Hydraulic fracture initiation refers to the initial forming of a crack, where pressure exceeds the sum of the minimum principal stress plus the tensile strength of the rock. Breakdown pressure may be measured or observed as a macroscopic property of the formation for evaluating fracturing conditions, while hydraulic fracture initiation may be estimated from mathematical modeling. In an example for determining breakdown pressure of a hydraulic fracturing operation, a borehole may be drilled in a minimum horizontal stress direction, where stresses acting on the borehole wall include vertical stress $\sigma_v$ and maximum horizontal stress $\sigma_H$. Fracture may be initiated at a point along the borehole where the hoop stress becomes minimum. In an intact rock (absence of natural fractures), this point may lie in the direction of the maximum of the two stresses acting on the borehole.

Figure 4:
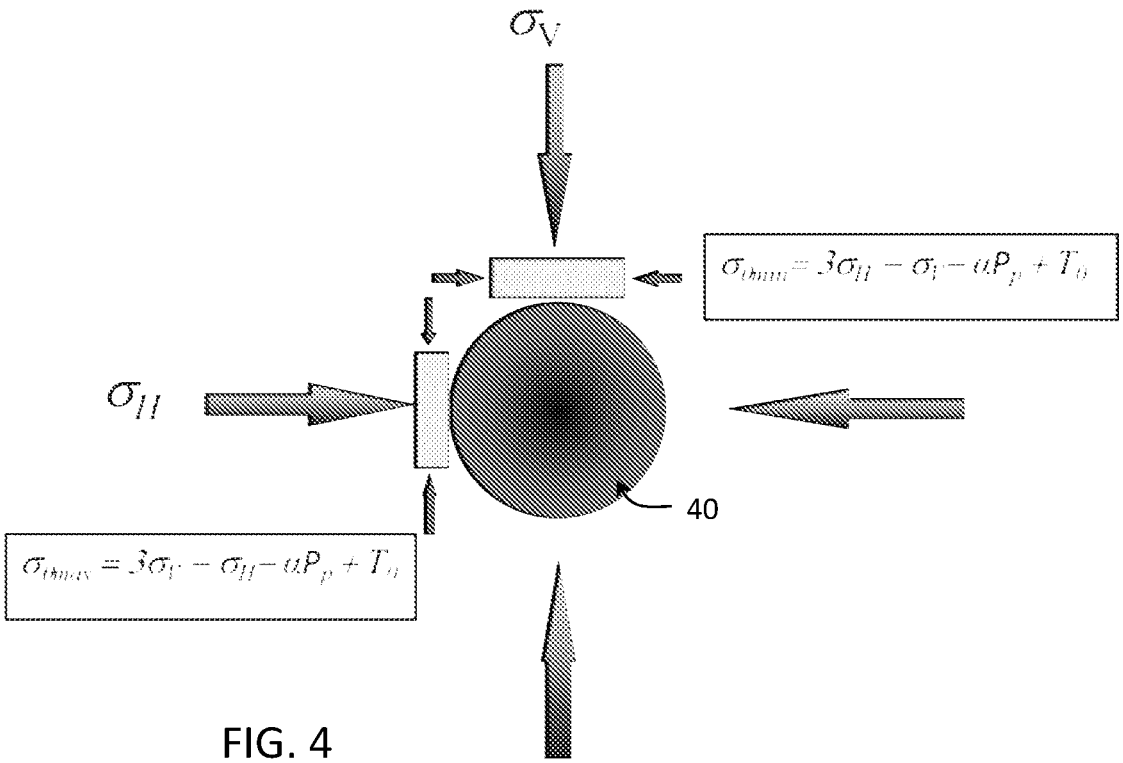
FIG. 4 shows stresses acting on a horizontal well drilled in the direction of minimum horizontal stress in a normal stress regime.
Figure 5:
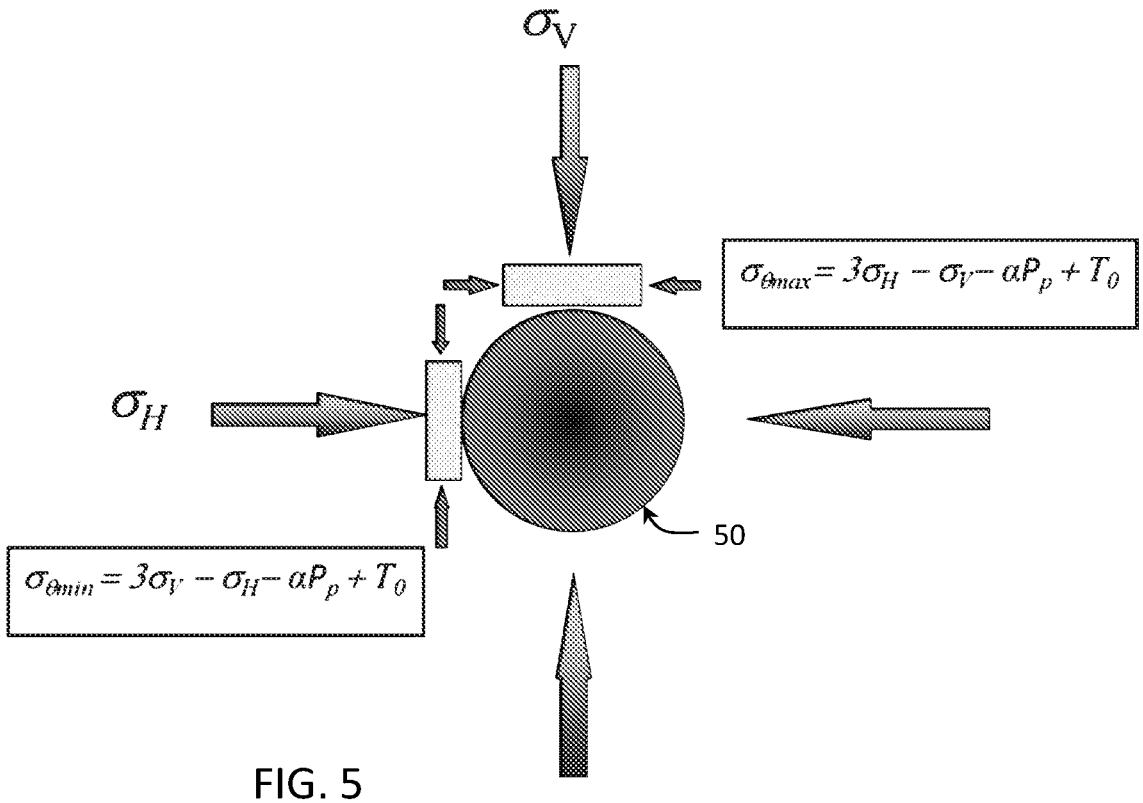
FIG. 5 shows stresses acting on a horizontal well drilled in the direction of minimum horizontal stress in a thrust stress regime.

FIG. 4 shows an example of a horizontal borehole 40 drilled in the direction of minimum horizontal stress in a normal stress regime. Vertical stresses $\sigma_v$ act on the top and bottom of the borehole 40, and maximum horizontal stresses $\sigma_H$ act on the sides of the borehole 40. In the normal stress regime, the minimum hoop stress $\sigma_{\theta min}$ is in the direction of the vertical stress $\sigma_v$ (the maximum of the principle stresses acting on the borehole), and thus, fracture may be initiated at the top and bottom of the borehole. FIG. 5 shows an example of a horizontal well 50 drilled in the direction of minimum horizontal stress in a thrust stress regime. Vertical stresses $\sigma_v$ act on the top and bottom of the borehole 50, and maximum horizontal stresses $\sigma_H$ act on the sides of the borehole 50. In the thrust stress regime, the minimum hoop stress $\sigma_{\theta min}$ is in the direction of the maximum horizontal stress $\sigma_H$ (the maximum of the principle stresses acting on the borehole), and thus, fracture may be initiated at the sides of the borehole.

Minimum hoop stress for breakdown pressure in a horizontal well drilled in a minimum horizontal stress direction in a thrust stress regime may be calculated using the following equation:

$$\sigma'_{\theta min}=3\sigma'_V-\sigma'_H-\alpha p_p+T_0 \quad (1)$$

For low porosity tight rock, the minimum hoop stress equation for breakdown pressure can be modified as follows:

$$(p_w-2\eta p_p)=\left(\frac{-T_o-a\sigma_{V'}-b\sigma_{H'}}{c(1+\beta-2\eta)}\right) \quad (2)$$

$$\eta=\frac{\propto(1-2v)}{2(1-v)} \quad (3)$$

Where a=3, b=−1, and c=−1 are the isotropic geometrical coefficients (for anisotropic rock, these coefficients depend on 0, i.e., the angle between maximum stress and the point of interest on borehole wall), $E_H/E_v$ (strain coefficients), and $(G_V/E_H)$; $\beta$ is a porosity dependent coefficient that varies between 0 and 1 in rocks with vanishing porosity (as porosity approaches to zero); $\alpha$ is Biot's poro-elastic coefficient; $T_0$ is the tensile strength of the rock; v is Poisson's ratio; $(E_H/E_V)$ is strain coefficients used by the poroelastic analytical method; $p_w$ is wellbore pressure; and $p_p$ is pore pressure.

Figure 6:
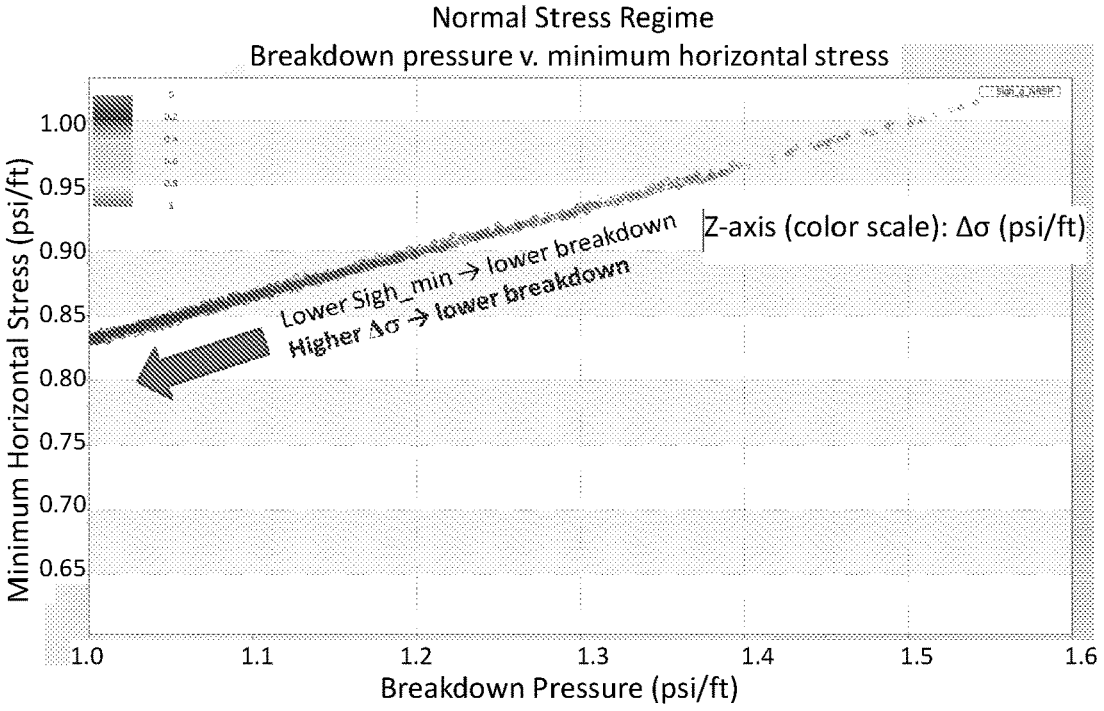
FIG. 6 shows a graph of a breakdown pressure in a normal stress regime.
Figure 7:
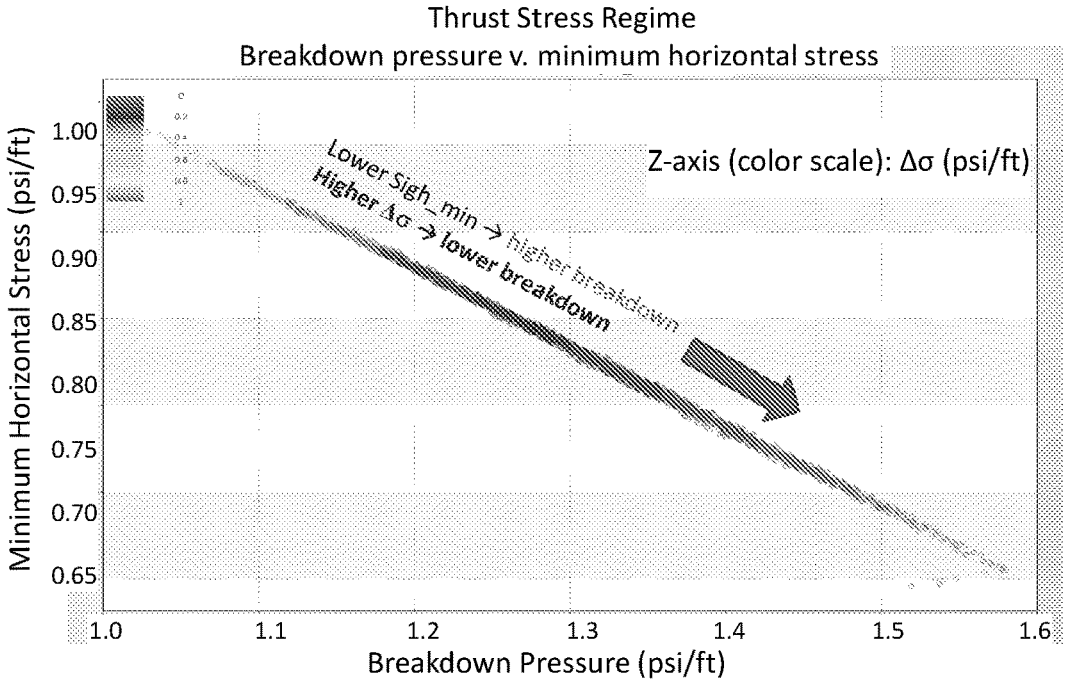
FIG. 7 shows a graph of the relationship between breakdown pressure and minimum horizontal stress in a thrust stress regime.

Reservoir access locations, such as perforation clusters, in a lateral well may be selected based on the minimum horizontal stress in a localized normal stress regime, as intervals with lower minimum horizontal stress may be relatively easier to initiate hydraulic fractures and to extend (propagate) fractures away from the wellbore, thus contacting more reservoir area. This approach may be used in formations in a normal stress regime for selection of intervals for reservoir access locations. Breakdown pressure in a normal stress regime estimated using equation 1 and 2 for an isotropic case, as shown in FIG. 6, is directly proportional to minimum horizontal stress, i.e., the lower the $\sigma_{hmin}$, the lower the breakdown pressure. However, in non-normal stress regimes such as strike-slip stress regimes and thrust stress regimes, the approach used in normal stress regimes may not be effective. In fact, breakdown pressure in non-normal stress regimes is observed to be inversely proportional to minimum horizontal stress, i.e., breakdown pressure is found to be higher in intervals of lower minimum horizontal stress. For example, in a reverse stress regime, breakdown pressure estimated using equation 1 and 2 is inversely proportional to minimum horizontal stress, i.e., the lower the $\sigma_{hmin}$, the higher the breakdown pressure, as shown in FIG. 7.

Figure 8:
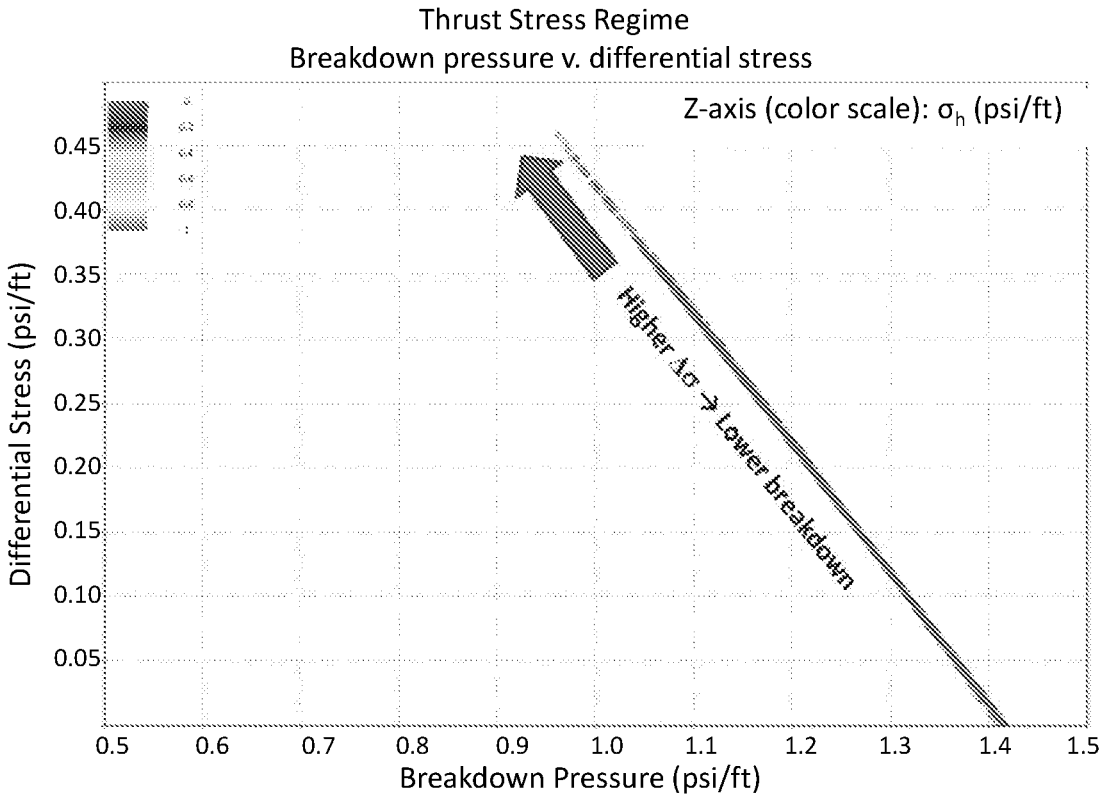
FIG. 8 shows a graph of the relationship between breakdown pressure and differential stress in a thrust stress regime.

Thus, rather than using $\sigma_{hmin}$ alone to select reservoir access intervals, a new parameter, $\Delta\sigma$, differential stress (difference of two principle stresses acting on the borehole) may be used in embodiments of the present disclosure to identify reservoir access intervals that have lower breakdown pressure. As illustrated FIG. 8, the higher the $\Delta\sigma$ measured along a borehole, the lower the breakdown pressure. The differential stress parameter may be used in thrust stress regimes, strike-slip stress regimes, and normal stress regimes to identify intervals of lower breakdown pressure more effectively. FIGS. 6 and 7 also show the relationship between differential stress ($\Delta\sigma$) and breakdown pressure, where differential stress is plotted along the z-axis, indicated with the color scale. As shown in FIG. 6, as the differential stress increases, the breakdown pressure decreases in a normal stress regime. As shown in FIG. 7, as the differential stress increases, the breakdown pressure decreases in a thrust stress regime.

Methods according to embodiments of the present disclosure may include calculating a differential stress along a borehole, where the differential stress is the difference in magnitude between two principle stresses acting on the borehole, and where the principle stresses are selected from vertical stress, minimum horizontal stress, and maximum horizontal stress. Once the differential stress along at least a portion of the borehole is calculated, at least one location may be selected along the borehole having a relatively higher differential stress when compared with the remaining calculated differential stresses. The borehole may then be perforated or otherwise have reservoir access formed at the at least one location having relatively higher differential stress. Methods of the present disclosure that include calculating a differential stress along at least a portion of a borehole may include, for example, methods for designing hydraulic fracturing operations, methods of perforating a borehole, methods of simulating hydraulic fracturing operations, methods related to optimizing perforating in hydraulic fracturing operations, and other methods related to optimizing reservoir access between a borehole and a reservoir.

As discussed above, breakdown pressure along a borehole is related to the differential stress, i.e., the difference in magnitude between two principle stresses acting on the borehole. In a normal stress regime, when a horizontal well is drilled in minimum stress direction, intervals of lower minimum horizontal stress ($\sigma_{hmin}$) can have lower breakdown pressure. However, in strike-slip and thrust stress regimes, intervals of lower minimum horizontal stress ($\sigma_{hmin}$) can have higher breakdown pressure. Because differential stress ($\Delta\sigma$) is inversely related to breakdown pressure in normal, strike-slip and thrust stress regimes, differential stress may be used in each regime to estimate breakdown pressure. The relationship between differential stress and breakdown pressure (increases in differential stress may result in decreased breakdown pressure and relatively lower differential stress may result in relatively higher breakdown pressure) is applicable in each stress regime (normal, strike-slip and thrust stress regimes). Accordingly, embodiments of the present disclosure may incorporate differential stress calculations in criterion for selecting reservoir access intervals along at least a portion of a borehole.

Once fracture is initiated, the smallest principle stress ($\sigma_{min}$) may be used as a guide for fracture growth, where intervals of lower $\sigma_{min}$ may require lower fracture propagation pressure. For example, according to embodiments of the present disclosure, a lowest principle stress may be determined along locations of a borehole having a relatively higher differential stress when compared with the remaining calculated differential stresses. One or more reservoir access locations may then be selected from a location along the borehole having the smallest magnitude of the lowest principle stress in addition to a relatively higher differential stress when compared with the remaining calculated differential stresses.

In some embodiments, a relatively higher differential stress may include a calculated differential stress having a value within the top 20 percentile, top 10 percentile or top 5 percentile of the total amount of calculated differential stresses, e.g., the calculated differential stresses along an entire borehole or the calculated differential stresses along a primary borehole and an offset well. In some embodiments, upon calculating the differential stresses along a selected portion of a borehole, the values of which range from a lowest differential stress to a highest differential stress, a relatively higher differential stress may include a calculated differential stress having a value within 20 percent of the highest differential stress, within 10 percent of the highest differential stress, or within 5 percent of the highest differential stress.

According to embodiments of the present disclosure, a general approach for optimizing completions to enable hydraulic fracturing may include placing reservoir access locations (e.g., perforation clusters) in good reservoir quality (RQ) and good completion quality (CQ). The concept of localized stress regime heterogeneity may be captured in the form of CQ classes. CQ classes may be based on reservoir considerations such as stress regime, active tectonics, faults, reservoir thickness, natural fractures, laminations, sylolites, and depositional orientation. For example, a first CQ class may refer to locations where conditions lead to the formation of vertical hydraulic fractures, a second CQ class may refer to locations where conditions lead to the formation of a twist/turn or T-shape in the hydraulic fracture, and a third CQ class may refer to locations where conditions lead to the formation of hydraulic fracture with a horizontal component. The CQ class may indicate different challenges in drilling and completing a well.

One or more methods of the present disclosure may include identifying and quantifying completion quality characteristics, such as CQ classes or localized stress regimes. For example, according to embodiments of the present disclosure, one or more stress regime types (i.e., normal stress regime, thrust stress regime and strike-slip stress regime) may be identified along at least a portion of a borehole, and reservoir access locations may be determined based on the type of stress regime identified along the borehole. For example, when a normal stress regime is identified, reservoir access locations may be selected along at least one location in the normal stress regime having relatively lower minimum horizontal stress when compared with remaining minimum horizontal stress values measured along the normal stress regime. When a non-normal stress regime is identified, reservoir access locations may be selected along at least one location in the non-normal stress regime having relatively higher minimum horizontal stress when compared with remaining minimum horizontal stress values measured along the non-normal stress regime.

Methods of the present disclosure may utilize measurements characterizing the stress regime of a formation, for example, in order to optimize hydraulic fracturing operations of a drilled borehole, simulate a borehole and hydraulic fracturing performance in the simulated borehole, or design a hydraulic fracturing operation in either a simulated or already drilled borehole (e.g., including selecting reservoir access locations along the borehole). The measurements characterizing the stress regime of the formation (e.g., principle stresses acting on a borehole extending through the formation) may be used in an engineered approach to either a) target locations with normal stress regime, such as by changing the well trajectory or selecting the reservoir access locations to be within the identified normal stress regimes, or b) overcome fracture placement challenges in non-normal (strike-slip or thrust) stress regimes, such as by selecting the reservoir access locations in high stress regions of the non-normal stress regimes. Together, these approaches may provide an overall solution for enabling effective hydraulic fracturing treatments in formations with challenging geomechanical environments.

Measurements characterizing a formation may include, for example, density measurements, pore pressure measurements, temperature, types of formation (e.g., shale, sandstone, etc.), resistivity measurements, geochemical measurements, and core measurements (e.g., CT scanning, scratch testing, lamination/bedding/natural fracture/stylolite identification, etc.). Such measurements may be used to quantify the stress acting on a borehole. One or more stress regime types may be identified using measurements taken along the borehole quantifying stress. In the absence of measurement data, or in addition to measurement data, a regional trend may be predicted based on localized fault patterns. Measurements characterizing a formation may be taken, for example, using a sonic measurement tool and/or an image logging tool.

Further, measurements characterizing a formation may be used in modeling a reservoir system, for example, by using a mechanical earth model ("MEM"). As used herein, an MEM is a numerical representation of the geomechanical state of the reservoir, field, or basin. In addition to property distribution (e.g., density, porosity) and fracture system, an MEM may incorporate pore pressures, state of stress, and rock mechanical properties. The stresses on the reservoir may be caused by overburden weight (vertical stress), any superimposed tectonic forces, localized forces (e.g., resulting from faults, fractures, laminations, depositional orientation, variability in rock mechanical properties, etc), and by production and injection. Various types of MEMs may be used, such as well-centric MEMs (concentrated on borehole effects, such as breakouts, collapses, sanding, and wellbore stability issues, and may be used for near-well dynamic simulations) and field wide MEMs (may be used to evaluate the effects of drilling and producing for full-field dynamic simulations), which may include time-lapse modeling of fluid flow and pressure, temperature changes, and associated effects on stresses.

In early exploration stages, information and data may be limited to, for example, seismic data and one or a few offset wells. An MEM of a formation from early exploration stages may provide an initial expectation of wellbore or reservoir response. As new information accumulates, such as from additional data acquired in wellbores after or while drilling, well test data, or subsequent seismic surveys, a more detailed MEM of the rock formations at the reservoir level may be developed. MEMs may be used, for example, for designing completions, performing fracture stimulation, and simulating reservoir production.

Figure 9:
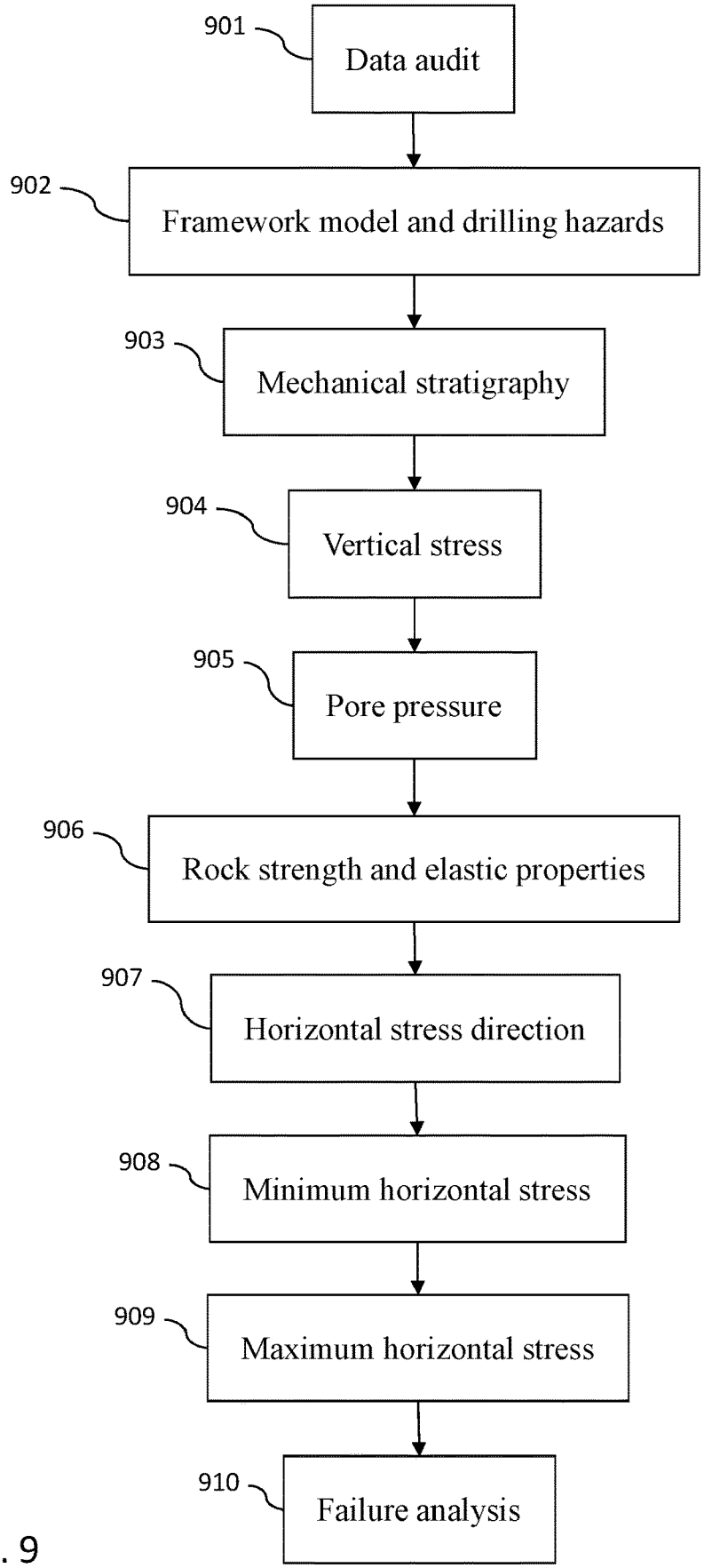
FIG. 9 shows a method for calculating and calibrating principle stresses acting on a borehole.

An example of a workflow for calculating stresses in a formation according to embodiments of the present disclosure is shown in FIG. 9, which may be used for calculating principle stresses of a borehole. As shown, a data audit 901 may be performed to collect data available of the formation being analyzed. For example, data may be collected using a sonic measurement tool or an image logging tool, and data may be collected from, for example, one or more current boreholes drilled in the formation, seismic testing, or one or more offset wells.

A three-dimensional model may then be constructed 902 to use as a framework model and determine drilling hazards. The model may be based on the data audit, and may include, for example, locations of major faults. The model may be constructed, for example, using MEM software or other modeling and/or simulation software.

The mechanical stratigraphy 903 of the formation may then be analyzed, including determining the type(s) of formation layers, such as shale, sandstone, etc.

Vertical stress 904 (or overburden stress) may be calculated as a function of position within a borehole through the formation. Vertical stress may be obtained by integration of density measurement data. For example, a vertical stress along a borehole may be calculated using the following equation:

$$\sigma_v = \int_0^z \rho_b(z) \cdot g \cdot dz$$

Pore pressure 905 (pressure of the fluid within formation pores) may be measured along the borehole using various types of tests, for example, using wireline formation testing devices, such as modular formation dynamics testers ("MDT") made by Schlumberger, and logging while drilling devices ("LWD"), such as formation pressure-while-drilling ("FPWD") devices, and/or by using production measurements. In some embodiments, a pore pressure profile may be estimated using sonic and resistivity logs and calibrated with available direct formation pressure data, such as collected from wireline formation testing devices.

Rock strength and elastic properties 906 may be used to calculate unconfined compressive strength of the formation along a borehole. Measurements may be based on data retrieved from log or core measurements, and may include, for example, fluid velocity measurements, tri-axial stress measurements, strength measurements, capillary pressure, steady-state and unsteady-state reservoir testing, wettability determinations, reservoir condition corefloods, improved oil recovery studies, petrophysical correlation measurements, core mechanical properties, pore volume compressibility, formation damage remediation, rock fluid sensitivity, particle migration, fluid compatibility, mud completion fluid damage, asphaltene precipitation, and relative permeability effects.

Further, dynamic Young's modulus (YME) and Poisson ratio (PR) may be estimated for the overburden and reservoir sections of the formation using available logs and standard equations for calculating YME and PR. Logging tools useful for acquiring data for calculating YME and PR may include, for example, density neutron tools, such as a bulk density measurement tool, sonic measurement-while-drilling tools, such a tool capable of measuring compressional delay time (Δtime/distance), and wireline logging tools such as a sonic imager capable of measuring shear wave delay time (Δtime/distance). Static models for YME and PR may be developed using robust rock property correlations that have been verified on a local basis and using core data. Further, empirical correlation using petrophysical logs and YME may be used to estimate uniaxial compressive strength (UCS) and calibrate with available core data.

Dynamic Poisson's ratio may be calculated using the following equation:

$$v_{dyn} = \frac{1/2\left(\frac{\Delta t_{shear}}{\Delta t_{comp}}\right)^2 - 1}{\left(\frac{\Delta t_{shear}}{\Delta t_{comp}}\right)^2 - 1}$$

The dynamic Young's modulus (YME) may be calculated using the following equation:

$$E_{dyn} = \frac{9 \times G_{dyn} \times K_{dyn}}{G_{dyn} + 3 \times K_{dyn}}$$

Horizontal stress directions may be determined 907 along the borehole. Horizontal stress direction may be determined, for example, using sonic logging tools, such as those that are capable of measuring acoustic velocity, images of the formation, and oriented calipers.

A poro-elastic model may be used to make an estimation of minimum horizontal stress 908 and maximum horizontal stress 909 using static Young's modulus, static Poisson's ratio, pore pressure and overburden stress (vertical stress) calculations. For example, the magnitude of minimum horizontal stresses acting on a borehole may be calculated based on data collected from logging. The magnitude of maximum horizontal stresses acting on a borehole may be determined, for example, based on data collected from image logs, analyzing drilling performance and modeling. Strain coefficients Ex and Ey may be calibrated using actual results from treatment analysis. Further, closure pressure may be used for determining a minimum horizontal stress profile. The minimum horizontal stress azimuth may be directly utilized in fast shear azimuth and breakout analysis.

A minimum horizontal stress along a borehole may be calculated using the following equation:

$$\sigma_h = \frac{v}{1-v}\sigma_v - \frac{v}{1-v}\alpha P_p + \alpha P_p + \frac{E}{1-v^2}\varepsilon_x + \frac{vE}{1-v^2}\varepsilon_y$$

A maximum horizontal stress along a borehole may be calculated using the following equation:

$$\sigma_H = \frac{v}{1-v}\sigma_v - \frac{v}{1-v}\alpha P_p + \alpha P_p + \frac{vE}{1-v^2}\varepsilon_x + \frac{E}{1-v^2}\varepsilon_y$$

A failure analysis 910 may be conducted to determine how predictive the model was and calibrate back any discrepancies between the predicted performance and measured performance. For example, a history match may be performed along a trajectory of a drilled planned well using the stress model and rock strength in the MEM with a failure criteria. Shear failure and tensile failures may be computed along the well trajectory. The predicted borehole failure (losses, breakouts, tensile induced fractures, etc.) may then be compared to actual data from the drilling reports or log caliper/image/shear radial variation profiles data. Breakdown data from the treatment summary may be utilized to further calibrate the MEM to correspond with the actual results.

Figure 10:
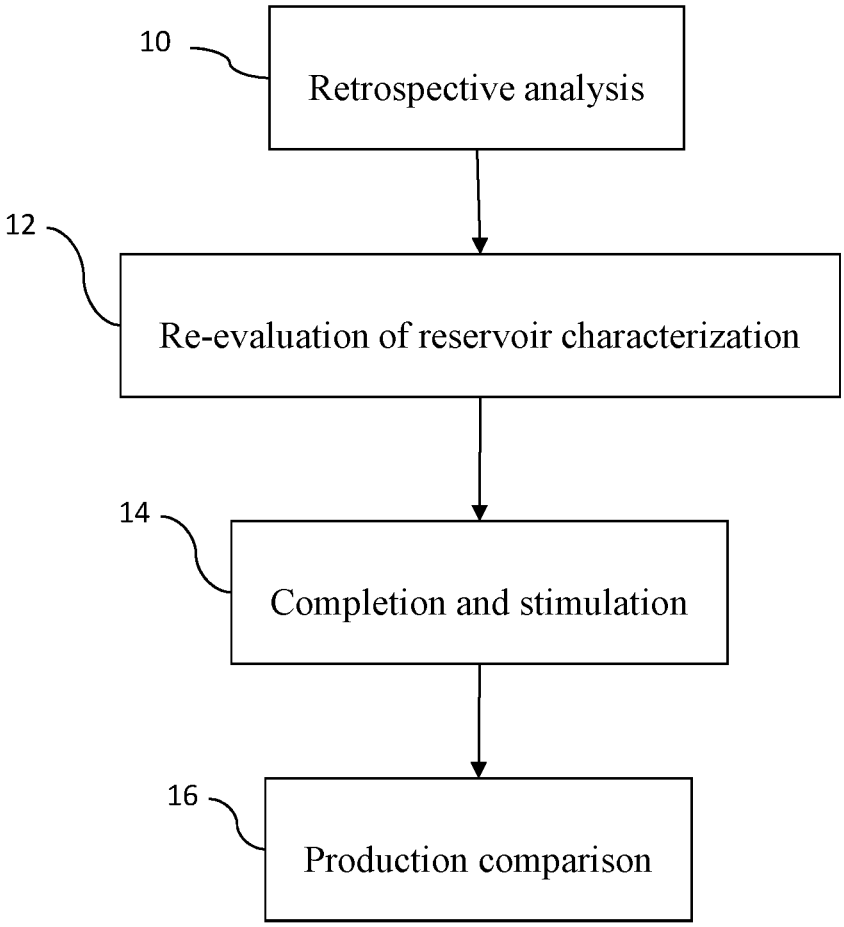
FIG. 10 shows a method for optimizing stimulation treatments in a borehole.

Further, an optimization workflow may include comparing previously conducted stimulation treatments, petrophysical and geomechanic analysis with current production performance. For example, FIG. 10 shows an example of an optimization workflow that integrates the performance results with reservoir quality, completion quality, and stimulation designs. By taking a holistic approach to understanding problems in production, an optimized strategy may be developed for various types of fields.

As shown, the workflow includes conducting a retrospective analysis 10, which may include analysis of a previously conducted stimulation, including the previously conducted stimulation design and production summary from the previously conducted stimulation. A performance indicator used for the analysis 10 may include production from well testing, including pre- and post-stimulation treatment. Folds of increase (FOI), post treatment, may be used to quantify the success of stimulation, while taking into account the reservoir quality. The retrospective analysis may also include designing a model of the well and its stimulation, for example, using a one-dimensional MEM of the well. The one-dimensional MEM may be modeled using fracture diagnostic tests.

A re-evaluation of the reservoir characterization 12 may be conducted to analyze the petrophysics and geomechanics of the reservoir. For example, data retrieved from wells being studied may include data from spectroscopy, nuclear magnetic resonance ("NMR"), images, sonic and core data. Petrophysical models used for volumetric analysis of these wells may be derived based on core analysis. A complete volumetric analysis may include deriving total and effective porosity, water saturation and intrinsic permeability. A petrophysics workflow may include a single or multi well analysis that allows quantification of differences in log responses of wells. The input logs of the analysis may be selected by the analyst and depend on the objectives of the study. For example, a petrophysics workflow may include using inputs of spectral gamma ray logs, density logs, neutron logs, deep resistivity and interpreted total porosity. The petrophysics workflow may be used, for example, to determine the RQ variability between wells (e.g., between the good and poor producers) over intervals of different formation types. Based on the production behavior, a comparison of good and poor producers may be analyzed from an RQ perspective while also considering the role of natural fractures, vertical stress contrast, and the stress regime (which relate to hydraulic fracture height growth and geometry).

A geomechanics analysis may include calibrating the model created for the retrospective analysis 10 by accounting for the effects of strike-slip or thrust stress regimes, which may affect the fracture geometry, such as height. The geomechanics analysis may be conducted to understand the vertical and lateral variation of both the mechanical properties and the in-situ stresses and to provide reliable parameters for the fracturing design.

According to embodiments of the present disclosure, one or more MEMs that are calibrated to account for stresses on each well may be created for a reservoir for re-evaluation of reservoir characterization 12. For example, the mechanical properties of one or more wells may be modeled using the core data available from the wells from the petrophysics workflow. A stress profile may then be calibrated/validated using drilling information, fracture diagnostic test measurements and post fracturing behavior. Tectonic parameters may be adjusted to re-produce breakout during drilling and the fracture diagnostic tests measurements and the post fracturing behavior.

Further, a three dimensional MEM may be constructed to show rotation of stresses between wells in a field. For example, variation of the Young's Modulus (YME) may be calculated along one or more wells. The variation of YME may impact the behavior of the stresses along the well's depth and may indicate stress rotation, stress variability vertically and across the field, and a complex localized stress regime heterogeneity along the well. Lateral stresses on one or more wells may also be determined and incorporated in the three-dimensional MEM. The heterogeneity along a well may impact completion strategy and interval reservoir access selection during optimization of both fracture initiation and propagation to generate an effective conductivity between the formation and the well.

After re-evaluation of reservoir characterization 12, completion and stimulation 14 may be analyzed and optimized. As mentioned above, increased production may depend, in part, on choosing a well in a location having good reservoir quality. However, increasing production in wells having stress regime heterogeneity may depend on having both good reservoir quality and good completion quality. Completion quality includes a set of properties that allows for effective reservoir contact through the creation of optimal hydraulic fracture geometry that provides connectivity to the wellbore and maintains sufficient conductivity for hydrocarbon production. This effective reservoir contact may be enhanced by hydraulic fractures that connect to the pre-existing natural fractures, but may be negatively impacted by features such as laminations that may compromise vertical connectivity within the hydraulic fracture.

From geomechanics re-calibrated data obtained during the reservoir characterization 12, a critical net pay ("CNP") for each well may be calculated. CNP may be calculated as the thickness of a contiguous interval section in a completion class that is expected to contact the reservoir with a vertical hydraulic fracture. The creation of vertical hydraulic fractures may allow for successful production in tight reservoirs, especially when dealing with laminated reservoir and environments where the vertical permeability may be much lower than the horizontal permeability.

Stimulation design optimization may include selecting a target interval for forming reservoir access. Both reservoir quality and completion quality may influence reservoir access depth (e.g., perforation depth) and strategy. Optimized completion quality does not necessarily mean forming reservoir access locations at intervals subject to the lowest stress, but instead, may include forming reservoir access locations along locations where the highest CNP can be engineered. As discussed herein, CNP may be based on CQ class and localized stress regime heterogeneity. For example, CNP may be the combination of both normal and strike slip locations. However, if laminations with weak interfaces are present in the strike slip locations, then CNP may be reduced to the normal stress locations. By targeting the highest CNP, the stimulation treatment may contact more reservoir rock.

Stimulation design optimization may also include selecting a fluid for hydraulic fracturing. For example, hydraulic fracturing treatments may include using an acid (acid fracturing) or a proppant (proppant fracturing) for stimulation. The rate of reaction may depend on fluid rate and bottomhole static temperature, and thus, may affect depth of penetration and reservoir contact surface area created by the hydraulic fracture.

After completion and stimulation 14, production from one or more wells may be compared 16 with the models constructed during the reservoir characterization and/or with each other. For example, production from a well completed across a relatively high naturally fractured reservoir having a relatively high CNP may be more than production from a well completed with relatively low amounts of natural fractures. By comparing the two productions, contributions from stimulation design versus natural fractures may be analyzed.

According to embodiments of the present disclosure, an optimization workflow that includes a reservoir-level petrophysical evaluation of existing wells may be performed and compared to understand the reservoir heterogeneity and production potential. For example, multiple rock classes may be identified within a formation interval, with a gross thickness of ~250 ft. Starting with log based MEM, results from the image log interpretation and the field observations/measurements from fracture diagnostic tests (e.g., Decline Analysis, After Closure Analysis, Calibration Injections) may be used in calibrating the MEM and mapping the Completion Quality (CQ) heterogeneity across the field. This may provide a reservoir-level understanding, which may be used for designing optimal well locations, target optimal formation intervals, and designing subsequent well placement/completions methodology. Further, using the reservoir-level evaluation, an optimum design to effectively stimulate ultralow-permeability formation intervals may be achieved. Optimization workflows of the present disclosure may include a single faceted approach of fracture modeling, as well as, a production forecast using a reservoir simulator, for example, for designing horizontal wells (landing point, trajectory for optimal stimulation geometry).

According to embodiments of the present disclosure, an engineered approach may be conducted for staging and completion design in geomechanically challenging regions by, a) defining the CNP in one or more wells and b) providing a workflow for estimating CNP in highly heterogeneous reservoirs. The staging and reservoir access design may be conducted for a vertical well, and for identifying vertical landing points and well placement strategy for a lateral well. The engineered approach using CNP may improve overall success of stimulation treatments in tectonically active areas.

Due to tool resolution and MEM workflow uncertainty, undue fluctuation in tool readings of stress may or may not be true. Thus, instead of using the data as is, a moving average of stress may be performed to estimate CNP. CNP may be estimated using CQ Class as a basis. As discussed above, CQ Class 1 may denote locations where conditions lead to the formation of vertical hydraulic fractures, CQ Class 2 may denote locations where conditions lead to the formation of a twist/turn in the hydraulic fracture, and CQ Class 3 may denote locations where conditions lead to the formation of hydraulic fracture with a horizontal component. Points for moving average depend on the vertical heterogeneity from a discrete log, which is generated as a ratio of stress change to absolute stress. Cutoff value for CNP may then be the average of CQ Classes, when frequency of CQ Class 3 is at least (X/n), where X is the number of moving average points and n is the number of classes present in the dataset. Other weighted averages and cutoffs may be used.

An engineered approach for staging and completion design may include estimating three principal stresses (highest vertical resolution possible) along a well using 1D MEM workflows. After the principal stresses have been defined along the well, stress regime and CQ Class at each depth interval may be identified using the magnitude of the three principal stresses (vertical, minimum horizontal and maximum horizontal), as described herein. Namely, in normal stress regime, one of the horizontal stresses is the least of the three, while the vertical stress is the largest. However, in tectonically active areas, one of the horizontal stresses may become larger than vertical while the other horizontal remains to be the least, resulting in strike slip stress regime. In reverse/thrust stress regime, vertical stress is the smallest of three principle stresses, thus resulting in horizontal fracturing. After stress regimes have been identified, a moving average or weighted average may be used to estimate CNP, rather than using the MEM data as is. The sample size for moving or weighted average may depend on the severity of vertical heterogeneity in a well. For example, the sample size may be identified using a proportional reasoning technique and CQ Class at each depth. Proportional reasoning technique is when discrete log thickness, as described above, is less than tool processing resolution. For example, if the CQ Class is varying at an interval of about x feet, and the tool resolution is y feet, then the number of points for moving average will be y/x.

An example of workflow data for determining a cutoff value for CNP is provided in Table 1 below.

TABLE 1

| Depth, ft | Overbuden Stress, psi | Minimum Horizontal Stress, psi | Maximum Horizontal Stress, psi | CQ Class | Critical Net Pay | CQ Class | ID |
|---|---|---|---|---|---|---|---|
| 8,745 | 8,428 | 9,284 | 12,527 | 3 | 0 | Class 3 | 3 |
| 8,746 | 8,428 | 9,344 | 12,619 | 3 | 0 | Class 2 | 2 |
| 8,747 | 8,429 | 9,064 | 12,091 | 3 | 0 | Class 1 | 1 |
| 8,748 | 8,430 | 7,080 | 8,796 | 2 | 9 | | |
| 8,749 | 8,430 | 6,884 | 7,834 | 1 | 8 | | |
| 8,750 | 8,431 | 7,926 | 8,806 | 2 | 7 | N | 3 |

TABLE 1-continued

| Depth, ft | Over-buden Stress, psi | Minimum Horizontal Stress, psi | Maximum Horizontal Stress, psi | CQ Class | Critical Net Pay | CQ Class | ID |
|---|---|---|---|---|---|---|---|
| 8,751 | 8,432 | 7,813 | 8,713 | 2 | 6 | n | 2 |
| 8,752 | 8,432 | 7,450 | 8,333 | 1 | 5 | | |
| 8,753 | 8,433 | 7,810 | 8,748 | 2 | 4 | Cutoff 2.67 | |
| 8,754 | 8,434 | 7,604 | 8,541 | 2 | 3 | | |
| 8,755 | 8,434 | 7,591 | 8,528 | 2 | 2 | | |
| 8,756 | 8,435 | 7,835 | 9,089 | 2 | 1 | | |
| 8,757 | 8,435 | 8,975 | 11,406 | 3 | 0 | | |
| 8,758 | 8,436 | 9,698 | 12,699 | 3 | 0 | | |
| 8,759 | 8,437 | 8,473 | 10,402 | 3 | 0 | | |
| 8,760 | 8,437 | 7,099 | 8,219 | 1 | 2 | | |
| 8,761 | 8,438 | 8,222 | 9,545 | 2 | 1 | | |
| 8,762 | 8,439 | 8,638 | 10,759 | 3 | 0 | | |
| 8,763 | 8,439 | 9,341 | 12,231 | 3 | 0 | | |
| 8,764 | 8,440 | 8,908 | 11,519 | 3 | 0 | | |
| 8,765 | 8,441 | 7,745 | 9,365 | 2 | 5 | | |
| 8,766 | 8,441 | 7,842 | 9,356 | 2 | 4 | | |
| 8,767 | 8,442 | 8,309 | 10,204 | 2 | 3 | | |
| 8,768 | 8,442 | 8,349 | 10,266 | 2 | 2 | | |
| 8,769 | 8,443 | 8,357 | 10,321 | 2 | 1 | | |
| 8,770 | 8,444 | 8,553 | 10,708 | 3 | 0 | | |
| 8,771 | 8,444 | 8,448 | 10,887 | 3 | 0 | | |

Figure 11:
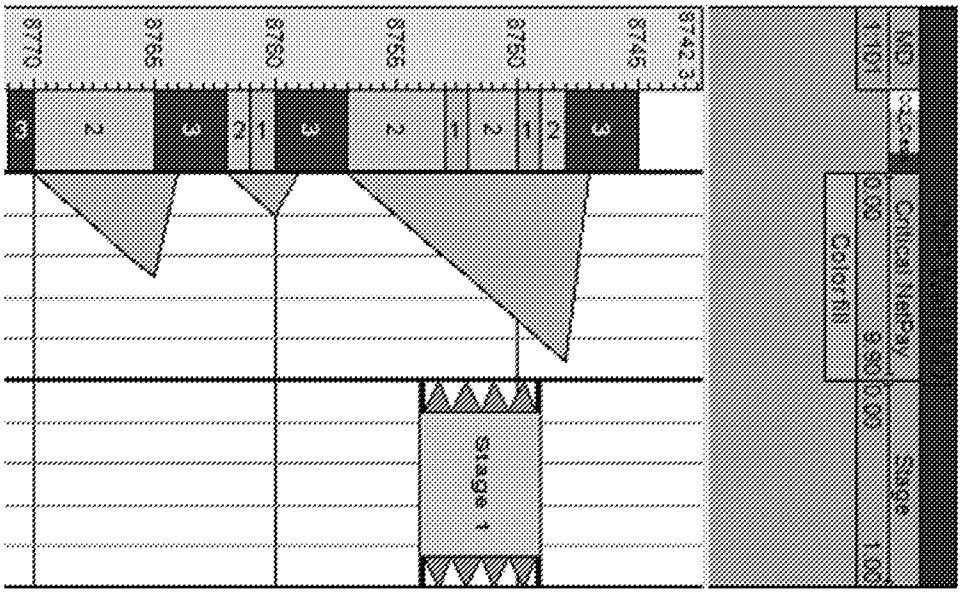
FIG. 11 shows an example of reservoir access locations selected along a borehole based on identified Critical Net Pay (CNP) along the borehole.

Once the CQ class and CNP have been identified along the well, stages for reservoir access locations along the well may be designed. For example, FIG. 11 shows a diagram of a portion of workflow data presented in Table 1 along a portion of a well. As shown, stages for reservoir access locations (Stage 1) may be designed to be located along the depths of the well having the largest CNP.

According to embodiments of the present disclosure, an optimization workflow may include targeting reservoir access locations within a localized normal stress regime. The reservoir access locations may be targeted in a localized normal stress regime by changing the trajectory of a borehole or by selecting locations along the borehole that are already in a localized normal stress regime. For example, according to some embodiments, a borehole may be designed to extend through at least one localized normal stress regime by collecting data characterizing a formation around at least a portion of the borehole, locating at least one localized normal stress regime based on the collected data, and altering a trajectory of the borehole to extend through the at least one localized normal stress regime.

In some embodiments, localized normal stress regimes may be located along an original trajectory of a borehole and along an altered trajectory of the borehole. For example, in some embodiments, initial formation data may be collected and used for designing an original trajectory plan of a borehole. During drilling, additional formation data may be collected, and based on the additional data, the original trajectory may be altered. For example, additional data may indicate a predicted area of the formation having a normal stress regime. By altering the trajectory of a borehole to extend through a normal stress regime, workflows for forming reservoir access (e.g., perforating) in normal stress regimes may be used along the borehole for finding optimized reservoir access locations that are more likely to have fracture initiation, fracture propagation, and fracture orientation in a vertical direction.

When the three principal stresses along a borehole are in normal stress regime condition, completion quality may be related to the minimum horizontal stress, where lower minimum horizontal stress may indicate better or preferred completion quality. In other words, under normal stress regime conditions, it may be easier to initiate and propagate fractures at locations along a wellbore having relatively lower magnitudes of minimum horizontal stress.

According to embodiments of the present disclosure, hydraulic fracturing operations may be modeled/simulated, such as by using MEM software, prior to carrying out the hydraulic fracturing operation. For example, in some embodiments, a formation and a borehole may be modeled, where data characterizing the formation may be collected from one or more previously drilled boreholes in the field, from seismic data, and/or from other means of testing a formation, such as discussed above in performing data audits. Upon modeling the borehole through the formation and/or the hydraulic fracturing operation, the borehole may be drilled through the formation. In some embodiments, a new trajectory of a borehole being drilled may be modeled to extend through at least one normal stress regime region. Based on the model of the new trajectory, the drilling direction of the borehole may be altered.

Once the borehole is drilled, the borehole may be completed and reservoir access locations may be selected, for example, based on modeling and by using reservoir access location selection methods disclosed herein. Reservoir access between the borehole and the reservoir may be achieved, for example, using perforation guns, jetting, or sliding sleeves. Hydraulic fracturing treatments may then be performed, for example, using acid fracturing treatments or proppant fracturing treatments.

In some embodiments, workflows for selecting optimized reservoir access locations may include selecting reservoir access locations in non-normal stress regimes (e.g., strike-slip stress regimes and thrust stress regimes). For example, when selecting reservoir access locations in non-normal stress regimes, reservoir access locations may be placed in higher local stress regions and/or in regions having a high differential stress between two principle stresses acting on the borehole, as discussed herein.

EXAMPLES

FIGS. 12-17 show examples of perforation locations selected along a borehole based on the localized stress regime heterogeneity modeled in an MEM of the borehole.

Figure 12:
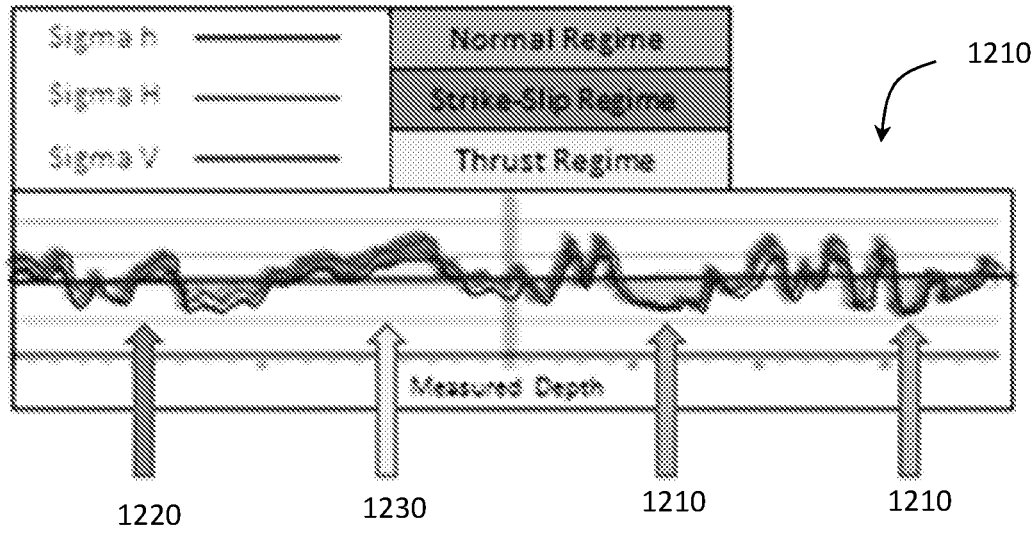
FIGS. 12-17 show examples of reservoir access locations selected along a borehole based on the localized stress regime heterogeneity modeled in a Mechanical Earth Model (MEM) of the borehole.

FIG. 12 shows a stress profile 1200 along a length of a borehole, illustrating changes between localized normal stress regimes, strike-slip stress regimes and thrust stress regimes. Optimized perforation locations in localized normal stress regimes 1210, in localized strike-slip stress regimes 1220, and in localized thrust stress regimes 1230 are shown. As shown, optimized perforation locations 1210 in localized normal stress regimes may be selected at regions having localized low minimum horizontal stress. Optimized perforation locations 1220 and 1230 in localized non-normal stress regimes may be determined using a breakdown workflow for determining optimized perforation locations in non-normal stress regimes. As discussed herein, breakdown workflows for determining optimized perforation locations in non-normal stress regimes may include selecting a location in the non-normal stress regime having relatively higher minimum horizontal stress when compared with remaining minimum horizontal stress values measured along the non-normal stress regime, or may include selecting a location in the non-normal stress regime having relatively higher differential stress (the difference between two principle stresses acting on the borehole) when compared with remaining differential stress values measured along the non-normal stress regime.

Figure 13:
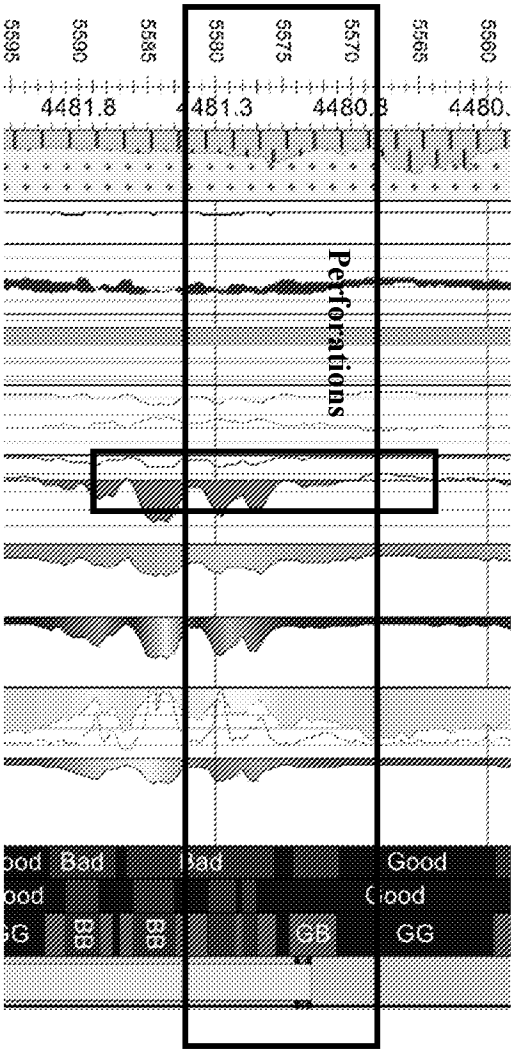

FIG. 13 shows an MEM of local stress regimes along a portion of a horizontal well. This stage of the well had 100% placement success when perforations were placed across the area where local stresses were in mostly normal stress regime conditions and in regions having low minimum horizontal stress.

Figure 14:
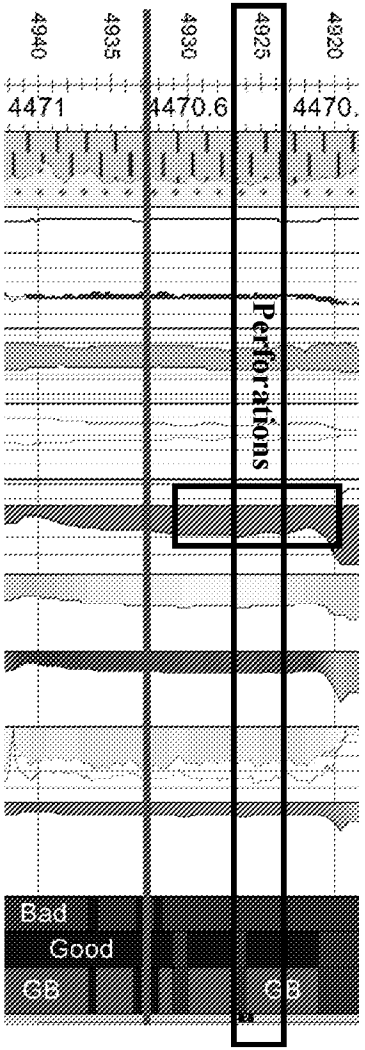

FIG. 14 shows an MEM of local stress regimes along a different portion of the horizontal well from FIG. 13. This stage of the well had 8% placement success when perforations were placed across the area where local stresses were in mostly strike-slip stress regime conditions, but were not placed in optimized perforation locations according to breakdown workflows in non-normal stress regimes disclosed herein.

Figure 15:
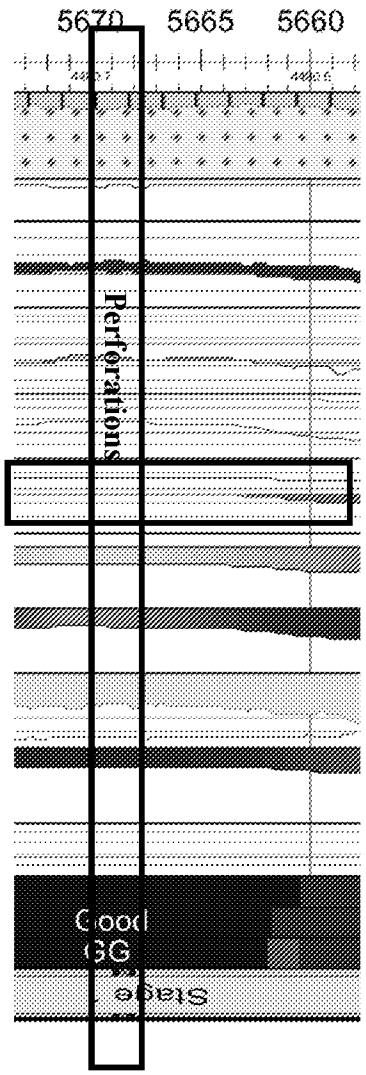

FIG. 15 shows an MEM of local stress regimes along a portion of another horizontal well. This stage of the well had 100% placement success when perforations were placed across the area where local stresses were in mostly normal stress regime conditions and in regions having low minimum horizontal stress.

Figure 16:
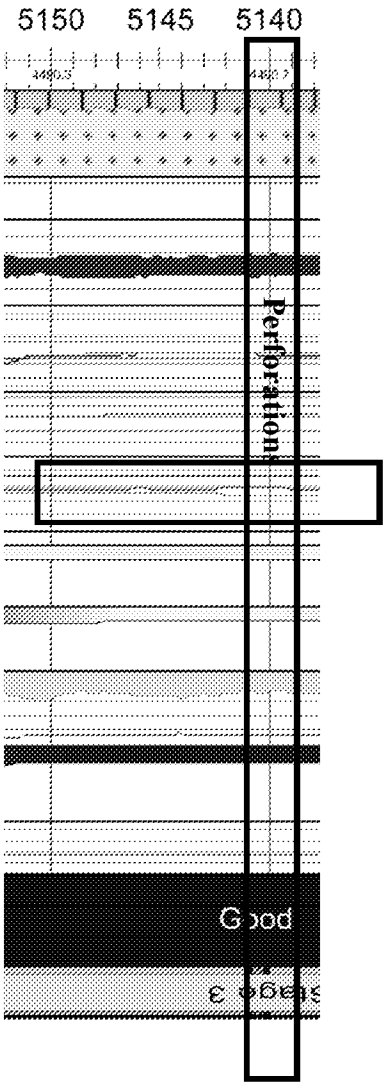

FIG. 16 shows an MEM of local stress regimes along a different portion of the horizontal well from FIG. 15. This stage of the well had 100% placement success when perforations were placed across the area where local stresses were in mostly normal stress regime conditions and in regions having low minimum horizontal stress.

Figure 17:
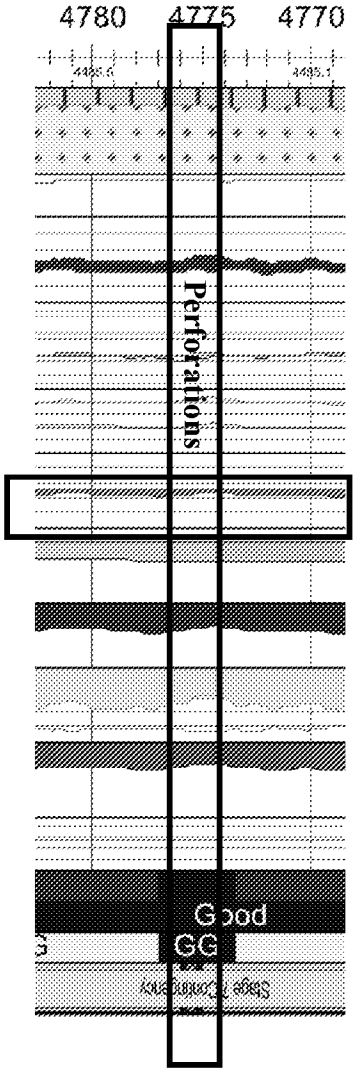

FIG. 17 shows an MEM of local stress regimes along a different portion of the horizontal well from FIG. 15. This stage of the well did not show success when perforations were placed across the area where local stresses were in mostly strike-slip stress regime conditions, but were not placed in optimized perforation locations according to breakdown workflows in non-normal stress regimes disclosed herein. This stage of the well was not successful due to high surface pressures and breakdown pressures.

While a limited number of embodiments are presented herein, those skilled in the art, having the benefit of this disclosure, will appreciate that other embodiments can be devised which do not depart from the scope of this disclosure. Accordingly, the scope of the invention should be limited only by the attached claims.

What is claimed is:

1. A method, comprising:

measuring principle stresses along a borehole, the principle stresses comprising vertical stress, minimum horizontal stress, and maximum horizontal stress;

identifying one or more stress regime types along at least a portion of the borehole based at least in part on the measured principle stresses, where the stress regime types are selected from a normal stress regime, a thrust stress regime and a strike-slip stress regime, wherein at least one normal stress regime is identified; and selecting reservoir access locations along the borehole based at least in part on a type of stress regime identified along the borehole, wherein the reservoir access locations are selected along the borehole in the at least one normal stress regime having relatively lower minimum horizontal stress when compared with minimum horizontal stress values at remaining locations along the at least one normal stress regime.

2. The method in claim 1, wherein the reservoir access locations are further selected based at least in part on reservoir quality and completion quality along the borehole.

3. The method of claim 1, wherein the principle stresses along the borehole are measured using at least one of a sonic measurement tool, an image logging tool, core measurements, seismic data, MDT, or fracture diagnostics tests.

4. The method of claim 1, further comprising:

collecting data from a formation;

simulating the borehole extending through the formation; and identifying the stress regime types along the simulated borehole.

5. The method of claim 4, further comprising modeling a new trajectory of the borehole to extend through a region of the formation having at least one identified normal stress regime.

6. The method of claim 4, further comprising drilling the borehole through the formation with a trajectory extending through at least one identified normal stress regime.

7. The method of claim 1, wherein at least one of the reservoir access locations are selected to minimize a difference in measured minimum horizontal stress among the reservoir access locations.

8. The method of claim 1, further comprising forming the selected reservoir access locations along the borehole, wherein forming the selected reservoir access locations includes using at least one of perforation guns, perforating charges, abrasive jetting, notching, sliding sleeves, and rupture valves.

9. The method of claim 1, wherein at least one reservoir access location is selected in the stress regime types having a measured minimum horizontal stress as a lowest value of measured principle stresses.

10. A method, comprising:

calculating a differential stress along at least a portion of a borehole, where the differential stress is a difference between a magnitude of two principle stresses acting on the borehole, the two principle stresses selected from vertical stress, minimum horizontal stress, and maximum horizontal stress;

determining locations along the borehole having a relatively higher differential stress when compared with the calculated differential stresses at remaining locations along the borehole; and perforating the borehole at a reservoir access location selected from at least one of the determined locations.

11. The method of claim 10, wherein the locations are in at least one of a normal stress regime, a strike-slip stress regime and a thrust stress regime.

12. The method of claim 10, further comprising determining a lowest principle stress at the locations, wherein the reservoir access location is selected from a location having a smallest magnitude of the lowest principle stress.

13. The method of claim 10, wherein locations along the borehole having a relatively higher differential stress comprise locations with the calculated differential stress having a value within 20 percent of a highest differential stress calculated.

14. A method, comprising:

measuring principle stresses along a borehole, the principle stresses comprising vertical stress, minimum horizontal stress, and maximum horizontal stress;

identifying one or more stress regime types along at least a portion of the borehole based at least in part on the measured principle stresses, where the stress regime types are selected from a normal stress regime, a thrust stress regime and a strike-slip stress regime, wherein a non-normal stress regime is identified;

calculating a differential stress along the non-normal stress regime, where the differential stress is a difference between a magnitude of two principle stresses acting on the borehole, the two principle stresses selected from vertical stress, minimum horizontal stress, and maximum horizontal stress; and selecting reservoir access locations along the borehole based at least in part on a type of stress regime identified along the borehole, wherein the reservoir access locations are selected along at least one location in the non-normal stress regime having relatively higher differential stress when compared with differential stress values at remaining locations along the non-normal stress regime.

15. The method in claim 14, wherein the reservoir access locations are further selected based at least in part on reservoir quality and completion quality along the borehole.

16. The method of claim 14, wherein the principle stresses along the borehole are measured using at least one of a sonic measurement tool, an image logging tool, core measurements, seismic data, MDT, or fracture diagnostics tests.

17. The method of claim 14, further comprising:

collecting data from a formation;

simulating the borehole extending through the formation; and identifying the stress regime types along the simulated borehole.

18. The method of claim 17, further comprising modeling a new trajectory of the borehole to extend through a region of the formation having at least one identified normal stress regime.

19. The method of claim 17, further comprising drilling the borehole through the formation with a trajectory extending through at least one identified normal stress regime.

20. The method of claim 14, further comprising forming the selected reservoir access locations along the borehole, wherein forming the selected reservoir access locations includes using at least one of perforation guns, perforating charges, abrasive jetting, notching, sliding sleeves, and rupture valves.

* * * * *